US005624098A

United States Patent [19]

McDowell

[11] Patent Number: 5,624,098

[45] Date of Patent: Apr. 29, 1997

[54] ANTI-TIP ANCHOR DEVICE FOR AN APPLIANCE IN COMBINATION WITH AN INTERLOCK SWITCH

[75] Inventor: Marvin J. McDowell, Covington, Ohio

[73] Assignee: Whirlpool Corporation, Benton Harbor, Mich.

[21] Appl. No.: 420,584

[22] Filed: Apr. 11, 1995

[51] Int. Cl.[6] ..... F16M 13/00

[52] U.S. Cl. ..... 248/550; 248/500; 248/501; 248/680; 248/673; 248/188.8; 248/188.9

[58] Field of Search ..... 248/550, 188.8, 248/188.9, 673, 680, 500, 501

[56] References Cited

U.S. PATENT DOCUMENTS

| | | | |
|---|---|---|---|
| 3,912,350 | 10/1975 | Gurubatham . | |
| 4,169,569 | 10/1979 | Riegler et al. | 248/680 |
| 4,535,610 | 8/1985 | Fey et al. | 248/550 X |
| 4,669,695 | 6/1987 | Chou . | |
| 4,669,696 | 6/1987 | Petta | 248/550 |
| 4,754,948 | 7/1988 | Casciani . | |
| 4,878,645 | 11/1989 | O'Neill | 248/680 |
| 4,890,813 | 1/1990 | Johnson et al. | 248/500 X |
| 5,076,525 | 12/1991 | Whipple . | |
| 5,131,133 | 7/1992 | Peterson et al. | 248/502 X |
| 5,131,617 | 7/1992 | McGarrah | 248/500 |
| 5,169,114 | 12/1992 | O'Neill | 248/680 X |
| 5,192,123 | 3/1993 | Wallin | 248/500 X |
| 5,487,523 | 1/1996 | Ingram et al. | 248/500 X |

*Primary Examiner*—Carl D. Friedman
*Assistant Examiner*—W. Glen Edwards
*Attorney, Agent, or Firm*—Hill, Steadman & Simpson

[57] ABSTRACT

An anti-tip device is provided for an appliance in the form of a first bracket secured to a floor and having an open-ended slot for receiving a support leg of the appliance. A second bracket is secured to the first bracket and is capable of engaging an interlock switch of an appliance. The engagement of the interlock switch by the second bracket is indicative of proper installation of the appliance. Further, use of the appliance is prevented by improper installation using the control circuitry of the appliance connected to the interlock switch.

18 Claims, 2 Drawing Sheets

ANTI-TIP ANCHOR DEVICE FOR AN APPLIANCE IN COMBINATION WITH AN INTERLOCK SWITCH

BACKGROUND OF THE INVENTION

The present invention generally relates to an appliance and more particularly to a device for use in association with such an appliance to prevent the appliance from tipping over. Further, the present invention relates to an electrical interlock that prevents operation of the appliance unless the device for preventing tipping has been properly installed and engaged with the appliance.

Several types of appliances, such as ranges, dishwashers, refrigerators, etc., are subjected, from time to time during their use, to user applied loads in a downward direction outside of a perimeter defined by the supporting feet of the appliance. For example, when a dishwasher or oven door is opened, a user may apply a downward force on the open door. Such a force, if sufficiently applied, may cause the appliance to tip. If, in the case of an oven door, a hot pan is on a range portion of the oven, this could result in an undesirable condition.

One solution to avoiding such a tipping problem is disclosed in U.S. Pat. No. 4,669,695 to Chou. In the '695 patent, a device is provided for preventing tilting of an appliance relative to a wall that includes a pair of rigid support members mountable on the wall which cooperatively engage stop means on the appliance when it is positioned adjacent the wall. Each support member includes a first portion secured to the wall with a plurality of fasteners such that the rear face thereof firmly engages the wall. A second portion extends substantially perpendicular to the first portion including a stop means. Openings in the rear wall of the appliance include a second stop means which are aligned with the stop means on the second portion of the support member when the appliance is positioned adjacent the wall to thereby prevent tilting of the appliance.

U.S. Pat. No. 5,076,525 to Whipple discloses another anti-tip apparatus for an appliance which includes a generally L-shaped retaining bracket that mounts to the wall adjacent the appliance with one leg projecting forwardly to engage a retaining edge in the rear of the appliance. A downwardly extending hook member at the free end of the appliance engaging leg prevents the retaining edge from sliding off of the end of the retaining leg in the event of upward movement of the retaining edge as might result from forward tipping motion of the appliance.

A drawback of such known anti-tip devices for appliances is that often they are not installed, or if installed, the anti-tip devices may not be installed properly. If the anti-tip device is installed properly, often the device is not engaged with the appliance when the appliance is positioned. Often, the anti-tip device is disconnected to clean, to service or to relocate the appliance and then may not be properly connected. Such devices are often not readily obvious to a user as to whether the device is properly installed and engaged with the appliance when the appliance is in use.

A need, therefore, exists, for an improved device that overcomes the deficiencies of known anti-tip devices for appliances and provides an electrical interlock when the device is not properly installed and engaged.

SUMMARY OF THE INVENTION

The present invention provides a device preventing tipping of an appliance wherein the appliance is supported by legs. To this end, one of the legs of the appliance is captured by a bracket secured to the floor or other supporting surface for the appliance. A second bracket is provided to contact an interlock switch connected to control circuitry of the appliance such that improper installation of the appliance prevents the appliance from operating.

To this end, in an embodiment, the present invention provides a combined electrical interlock and tip-prevention device for an appliance on a support surface. The device has a first bracket having an opening receiving a leg of the appliance. An interlock switch is electrically connected to control circuitry of the appliance. A second bracket contacts the interlock switch of the appliance indicative of proper positioning of the leg in the first bracket.

In an embodiment, operation of the appliance is prevented when the second bracket is not in contact with the interlock switch.

In an embodiment, the device has a means for securing the first bracket to the support surface.

In an embodiment, the device has a means for securing the second bracket to the first bracket.

In an embodiment, the second bracket is L-shaped with a leg running parallel to the support surface and another leg running parallel to a peripheral wall of the appliance.

In another embodiment of the present invention, a method is provided for preventing use of an appliance due to improper installation of the appliance. The method comprises the steps of: providing a bracket to secure the appliance so as to prevent tipping of the appliance from an external force applied to the appliance; providing an interlock switch operatively connected to the appliance; and preventing operation of the appliance due to improper securing of the appliance to the bracket.

In an embodiment, the method further comprises the step of providing a connector attached to the bracket providing contact with the interlock switch.

In another embodiment of the present invention, a tip prevention and interlock device is provided in an appliance supported on a support surface. The device has a means for preventing the appliance from tipping attached to the support surface and an interlock switch contacting the means for preventing upon proper installation of the appliance.

In an embodiment, the means for preventing includes a bracket attached to the support surface capable of receiving a leg of the appliance.

In an embodiment, the interlock switch provides electrical actuation of control circuitry of the appliance.

In an embodiment, the means for preventing includes an L-shaped portion capable of contacting the interlock switch and securable to the support surface.

It is, therefore, an advantage of the present invention to provide a device and a method to prevent tipping of an appliance.

Yet another advantage of the present invention is to provide a device and a method to prevent operation of an appliance when improperly installed.

A still further advantage of the present invention is to provide a device and a method that guarantee proper installation in order to operate the device.

Moreover, an advantage of the present invention is to provide a device and a method that eliminates risks associated with use of the appliance on which the device is used.

DETAILED DESCRIPTION OF THE PREFERRED EMBODIMENTS

Figure 1:
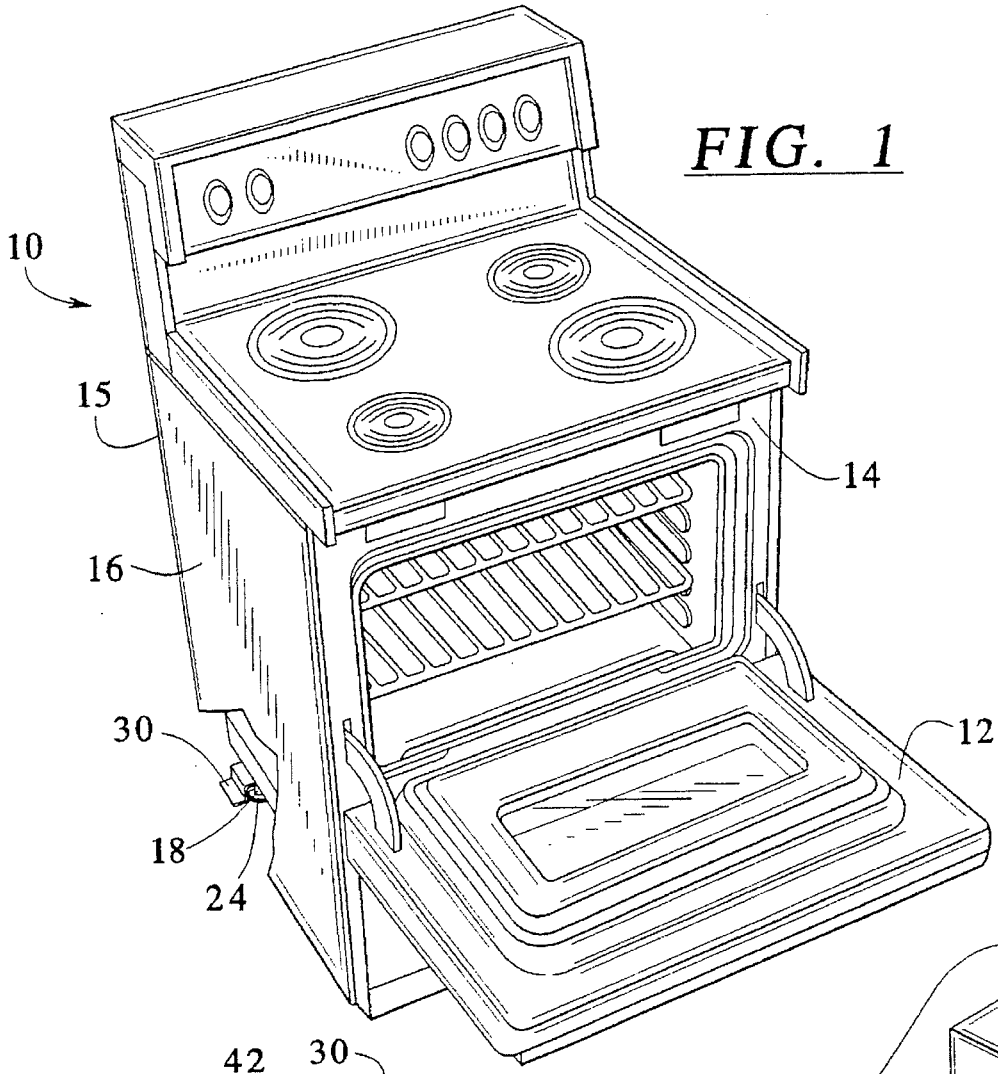
FIG. 1 is a perspective view of an embodiment of an appliance illustrating engagement of the appliance with the electrical interlock and anti-tip prevention device embodying the principles of the present invention.
Figure 2:
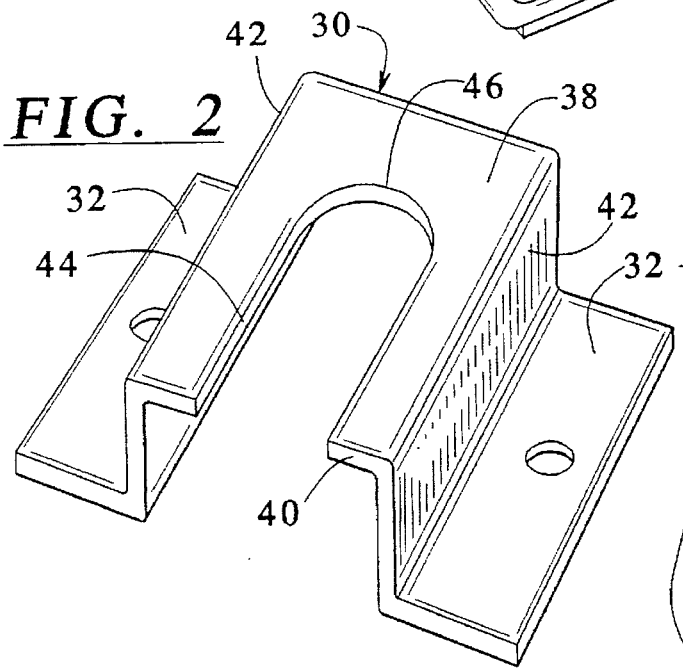
FIG. 2 is a perspective view of an embodiment of an anchor bracket used in conjunction with the electrical interlock and anti-tip device of the present invention.

In FIG. 1, there is illustrated an appliance generally designated at 10 which, in the illustration, is depicted as an electric range. However, the present invention can be utilized with other types of appliances, such as gas ranges, dishwashers, trash compactors, refrigerators, freezers, washers, dryers, ice makers, and other similar appliances.

The appliance 10, as illustrated, has a door 12 that is openable at a front side 14 of the appliance 10. In its open position, the door 12 extends outwardly beyond a perimeter of a cabinet 16 of the appliance 10. In such a configuration, a downward force may be applied on the open door 12. When such a force is applied outside the perimeter of the cabinet 16, the appliance 10 is subjected to tipping.

Appliances of this type are generally supported on four legs 18, each positioned adjacent a corner of the perimeter of the cabinet 16. Preferably, the legs 18 are adjustable to provide leveling of the appliance 10.

The appliance legs 18 typically have an enlarged distal foot 24 which rests upon a supporting surface 26, generally a floor in a room where the appliance 10 is located. As previously mentioned, if a downward force is applied on an open door 12, the appliance 10 may be caused to tip forwardly by a pivoting action at the front feet 18 of the appliance 10, resulting in the rear feet 18 lifting off of the supporting surface 26.

Figure 5:
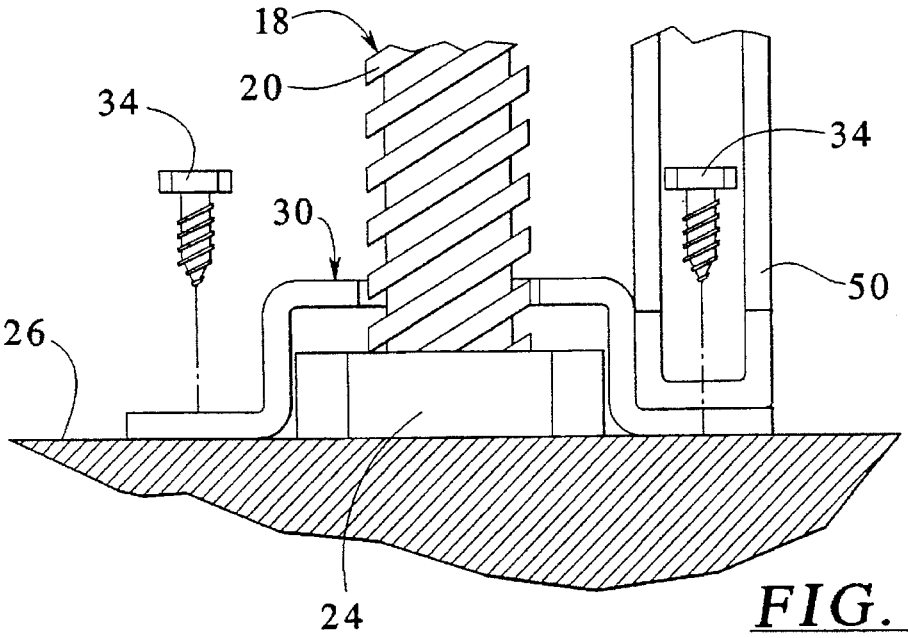
FIG. 5 is a partial cross-sectional view of an embodiment of the actuating bracket and the anchor bracket secured to the floor with a leg of an appliance extended therethrough.

A typical leg 18 is shown in greater detail in FIG. 5. The leg 18 has a proximal exterior threaded surface 20 above the distal foot 24 being relatively narrower than the foot 24 and which engages with a bottom support frame 22 of the appliance 10 to permit the leg 18 to be vertically adjustable. Such vertical adjustability is desirable to allow the appliance 10 to be leveled at its installation location.

Figure 4:
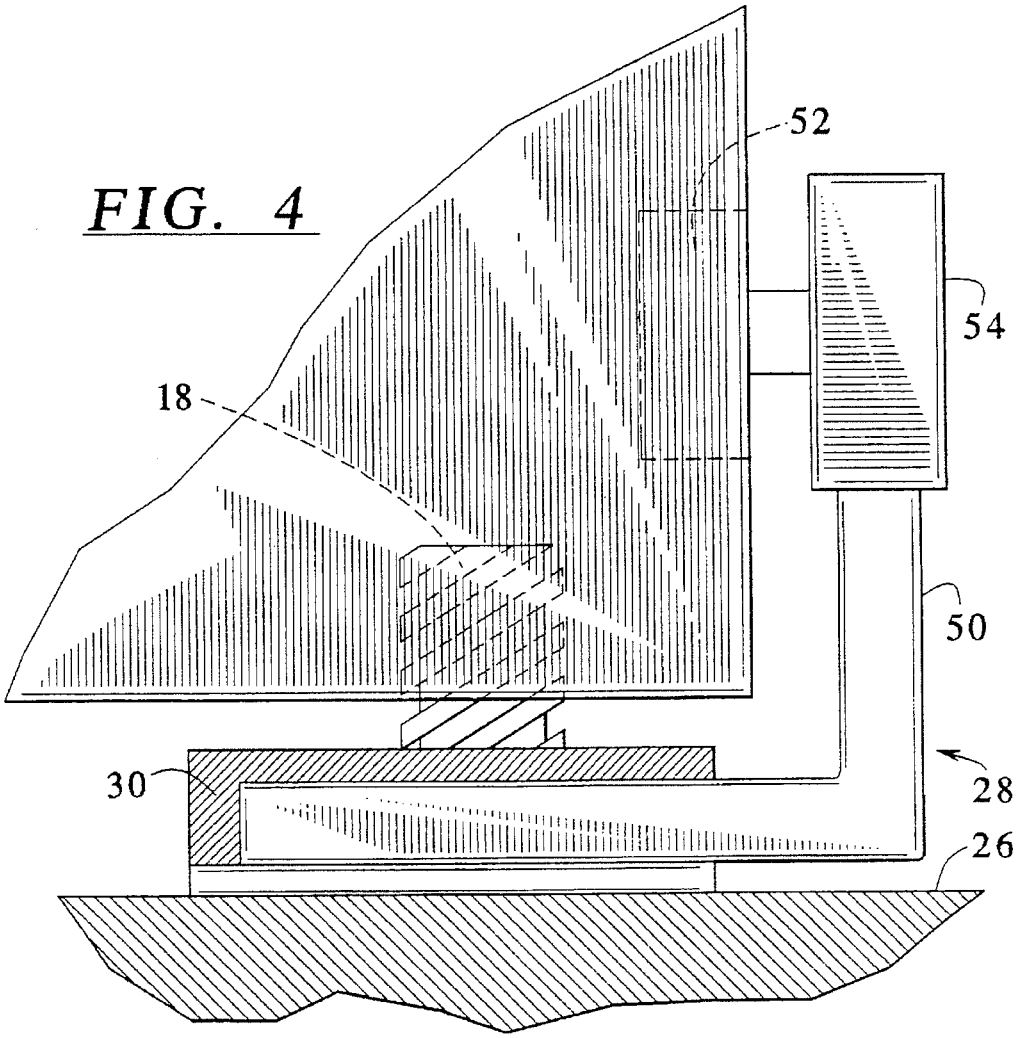
FIG. 4 is a partial cross-sectional view of an embodiment of the anchor bracket and actuating bracket connected to an interlock switch for an electrical interlock and anti-tip device of the present invention.

In accordance with the principles of the present invention, an electrical interlock and anti-tip device is generally shown in combination in FIG. 4 and designated at 28. The device 28 includes an anchor bracket 30. The bracket 30 is provided with a pair of laterally spaced, longitudinally extending side portions 32 which engage the support surface 26. In a preferred embodiment, fastening means 34, which may be in the form of threaded fasteners, extend through the lateral side portions 32 and engage into the support surface 26 to secure the anchor bracket 32 to the support surface 26.

A central portion 28 of the anchor bracket 30 has a top wall 40 raised above the supporting surface 26 by a pair of longitudinally extending side walls 42 connecting the top wall 40 with the side portion 32. A forwardly opening slot 44 is formed in the top wall 40 of the central portion 38 and terminates in a semi-circular bight 46.

Typically, a height of the side walls 42 of the central portion 38 is greater than a height of the foot portion 24 of the leg 18. Moreover, the lateral dimension of the slot 44 is less than a lateral dimension of the foot portion 24 but greater than a diameter of the leg 18. Thus, the distal foot 24 is easily received within a space defined between the support surface 26 and the top wall 40 of the anchor bracket 30 and is prevented from moving upwardly through the slot 44 due to the narrowness of the slot relative to the size of the distal foot 24.

Preferably, the lateral dimension of the slot 44 is less than the diameter of the leg 18 combined with one-half of the difference between the diameter and the lateral dimension of the foot 24 such that even if the leg 18 contacts the slot 44 on one side, the foot 24 on the opposite side is captured by the top wall 40 surrounding the slot 44. Further, the length of the slot 44 is preferably at least one and one-half times the diameter of the leg 18 to allow for variances in alignment of the appliance 10 during the installation process. For example, where the diameter of the leg 18 is one-inch, the length of the slot 44 should be at least one and one-half inches.

In order to install the bracket 30, the installed location of the appliance 10 must first be determined. Only a single bracket is required to be installed for an appliance, although more than one bracket may optionally be installed. A template can be used to mark locations for drilling mounting holes for the threaded fasteners 34 based upon the desired final locations of the appliance 10. The bracket 30 may then be secured to the support surface 26 by means of the fasteners 34 with the slot 44 opening toward the front. The appliance 10 is then moved rearwardly into position such that the position of the appliance 10 is received in the slot 44. The opening of the slot 44 in the central portion 38 of the anchor bracket 30 guides the leg 18 into the slot 44. With the foot 24 received in the space formed below the central portion 38 of the bracket 30, the appliance 10 is prevented from tipping. To this end, the foot 24 is incapable of moving upwardly after engaging the top wall 40 of the bracket 30. By placing the bracket 30 to engage a leg opposite the side of the door 12 of the appliance 10, tipping of the appliance 10 is prevented. In this instance, the door 10 is at the front of the appliance 10, and the bracket 30 is applied to at least one of the rear legs 18.

Figure 3:
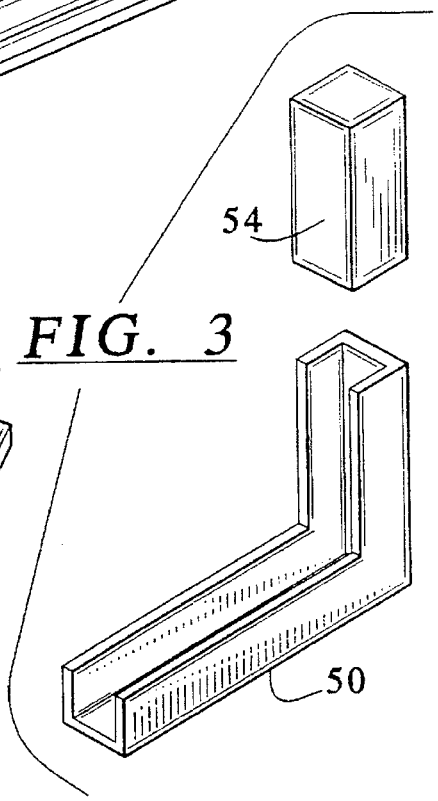
FIG. 3 is a perspective view of an embodiment of an actuator bracket used in conjunction with the anchor bracket for the electrical interlock and anti-tip device of the present invention.

As further illustrated in FIGS. 3–5, an actuator bracket 50 is attachable to the anchor bracket 30 using one of the fastening screws 34 to secure the actuator bracket 50 to the supporting surface 26 via attachment to the anchor bracket 30. The actuator bracket 50 is situated so as not to interfere with an opening for receiving the leg 18 of the appliance 10 into the slot 44 formed in the central portion 38 of the bracket 30. The actuator bracket 50 is preferably L-shaped such that the bracket 50 extends along the ground surface 26 and along a back side 15 of the appliance 10. On the back side 15 of the appliance 10 is an interlock switch 52. The interlock switch 52 is operatively connected to control circuitry of the appliance 10 such that the appliance 10 will not operate unless the switch 52 is closed by proper installation of the anti-tip device 28 with the appliance 10. To this end, the interlock switch 52 connected to a cap 54 at an end of the actuating bracket 50 completes the circuitry necessary to indicate proper installation of the appliance 10 onto the anti-tip device 28.

Without a proper connection, in a preferred embodiment, the appliance 10 is designed to not function in its designed manner. That is, for an oven or a range, the appliance 10 would be incapable of heating items that would pose a concern for burns from spillage of these items from the oven tipping. Therefore, if the appliance 10 cannot be used, the appliance 10 will be properly installed with the anti-tip device 28 so as to engage the interlock switch 52 of the anti-tip device 28. The cap 54 of the actuator bracket 50 also covers any sharp edges of the bracket 50 and increases the area of the surface which contacts the interlock switch 52 for actuation of the appliance 10 with proper installation of the same.

Of course, other shapes of anchor brackets 30, actuating brackets 50 and orientation of the interlock switch 52 on the appliance 10 may be implemented by those skilled in the art and the same is within the scope of this invention.

The use of the anti-tip device 28 requires no further action by a user following installation of the appliance 10 in that the leg 18 of the appliance 10 automatically engages or disengages with the anchor bracket 30 merely by forward or rearward movement of the appliance 10. Following placing of the appliance 10, the user does not require access to the anchor bracket 30, the actuator bracket 50, or the interlock switch 52. The dimensioning of the components assures proper alignment of the appliance 10 with the brackets 30 and 50 in order to engage the interlock switch 52 for proper alignment and use of the appliance 10 following installation.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A combined electrical interlock and tip prevention device for an appliance having legs for standing on a horizontal support surface, the device comprising:

a first bracket attached to the support surface having an opening formed in a plane parallel to the support surface wherein the opening is capable of receiving one of the legs of the appliance wherein the leg is in continuous contact with the support surface;

an interlock switch electrically connected to control circuitry of the appliance; and a second bracket attached to the first bracket wherein the second bracket contacts the interlock switch of the appliance when the leg of the appliance is properly positioned in the opening of the first bracket.

2. The device of claim 1 wherein operation of the appliance is prevented when the second bracket is not in contact with the interlock switch.

3. The device of claim 1 further comprising:

means for securing the first bracket to the support surface.

4. The device of claim 1 further comprising:

means for securing the second bracket to the first bracket.

5. The device of claim 1 wherein the second bracket is L-shaped with a leg running parallel to the support surface and another leg running parallel to a peripheral wall of the appliance.

6. The device of claim 1 wherein the first bracket has side portions and a central portion connected by side walls with the opening in the central portion.

7. The device of claim 1 further comprising:

a cap covering an end of the second bracket and capable of contacting the interlock switch.

8. A method for preventing use of an appliance due to improper installation of the appliance having legs supporting the appliance on a horizontal support surface, the method comprising the steps of:

providing a bracket attached to the horizontal support surface to secure at least one of the legs of the appliance on the horizontal support surface so as to prevent tipping of the appliance off the horizontal support surface from an external force applied to the appliance wherein the leg is in continuous contact with the support surface;

providing an interlock switch operatively connected to the appliance and to the bracket; and preventing operation of the appliance due to improper securing of the appliance to the bracket.

9. The method of claim 8 wherein the interlock switch is electrically connected to the appliance.

10. The method of claim 8 further comprising the step of:

providing a connector attached to the bracket providing contact with the interlock switch.

11. The method of claim 8 further comprising the step of:

fastening the bracket to a support surface on which the appliance operates.

12. The method of claim 8 wherein the bracket is permanently installed at a location at which the appliance is to operate.

13. In an appliance supported by legs on a support surface, a tip prevention and interlock device connected thereto comprising:

means for preventing the appliance from tipping wherein the means for preventing includes a bracket attached to the support surface and receives one of the legs of the appliance wherein the leg is in continuous contact with support surface; and an interlock switch contacting the means for preventing upon proper installation of one of the legs of the appliance in the bracket.

14. The device of claim 13 wherein the interlock switch provides electrical actuation of control circuitry of the appliance.

15. The device of claim 13 wherein the means for preventing includes an L-shaped portion capable of contacting the interlock switch and securable to the support surface.

16. The device of claim 13 wherein the means for preventing includes a cap portion to contact the interlock switch.

17. The device of claim 13 further comprising:

fastening means to secure the means for preventing to the support surface.

18. The device of claim 13 wherein the means for preventing includes a groove capable of receiving a leg of the appliance.

* * * * *

Disclaimer and Dedication 5,624,098—Marvin J. McDowell, Covington, Ohio. ANTI-TIP ANCHOR DEVICE FOR AN APPLIANCE IN COMBINATION WITH AN INTERLOCK SWITCH. Patent dated April 29, 1997. Disclaimer and Dedication filed October 1, 1997, by the assignee, Whirlpool Corp.

Hereby disclaims and dedicates to the Public the entire term of said patent.

*(Official Gazette,* December 9, 1997)